US008839734B2

(12) United States Patent
Khachaturian

(10) Patent No.: US 8,839,734 B2
(45) Date of Patent: Sep. 23, 2014

(54) ARTICULATED MULTIPLE BUOY MARINE PLATFORM APPARATUS AND METHOD OF INSTALLATION

(76) Inventor: Jon E. Khachaturian, New Orleans, LA (US)

( * ) Notice: Subject to any disclaimer, the term of this patent is extended or adjusted under 35 U.S.C. 154(b) by 91 days.

(21) Appl. No.: 13/240,422

(22) Filed: Sep. 22, 2011

(65) Prior Publication Data

US 2012/0090524 A1 Apr. 19, 2012

Related U.S. Application Data

(60) Provisional application No. 61/385,408, filed on Sep. 22, 2010.

(51) Int. Cl.

| | |
|---|---|
| ***B63B 35/44*** | (2006.01) |
| ***B63B 21/50*** | (2006.01) |
| ***B63B 9/06*** | (2006.01) |

(52) U.S. Cl.

CPC ..... *B63B 35/4413* (2013.01); *B63B 9/065* (2013.01); *B63B 21/50* (2013.01)

USPC ..... 114/258; 114/293

(58) Field of Classification Search

CPC ..... B63B 35/44; B63B 21/50; B63B 20/52; B63B 21/502

USPC ..... 114/264–266, 294

See application file for complete search history.

(56) References Cited

U.S. PATENT DOCUMENTS

| | | | | |
|---|---|---|---|---|
| 2,952,234 A | | 9/1960 | Levinson | |
| 3,540,396 A | | 11/1970 | Horton | |
| 3,552,343 A | | 1/1971 | Scott | |
| 3,572,041 A | | 3/1971 | Graaf | |
| 3,605,668 A | * | 9/1971 | Morgan | 114/293 |
| 3,673,973 A | * | 7/1972 | Glosten | 114/265 |
| 3,982,492 A | | 9/1976 | Steddum | |
| RE29,478 E | * | 11/1977 | Goren et al. | 114/265 |
| 4,286,538 A | | 9/1981 | Matsui | |
| 4,297,965 A | | 11/1981 | Horton et al. | |
| 4,620,820 A | | 11/1986 | Collipp | |
| 4,646,672 A | * | 3/1987 | Bennett et al. | 114/264 |
| 4,714,382 A | | 12/1987 | Khachaturian | |
| 5,197,825 A | | 3/1993 | Rasmussen | |
| 5,423,632 A | | 6/1995 | Ekvall et al. | |
| 5,439,060 A | | 8/1995 | Huete et al. | |
| 5,558,467 A | | 9/1996 | Horton | |

(Continued)

FOREIGN PATENT DOCUMENTS

GB 2092664 A 8/1982

*Primary Examiner* — Stephen Avila
*Assistant Examiner* — Andrew Polay
(74) *Attorney, Agent, or Firm* — Garvey, Smith, Nehrbass & North, L.L.C.; Charles C. Garvey, Jr.; Vanessa M. D'Souza

(57) ABSTRACT

A marine platform (and method of installation) provides a plurality of buoys of special configuration, a platform having a peripheral portion that includes a plurality of attachment positions, one attachment position for each buoy, and an articulating connection that connects each buoy to the platform at a respective attachment position, the connection allowing for sea state induced buoy motions while minimizing effect on the platform. A method of installation places the platform (including oil and gas drilling and/or production facility) next to the buoys. Ballasting moves the platform and buoys relative to one another until connections are perfected between each buoy and the platform.

32 Claims, 19 Drawing Sheets

(56) References Cited

U.S. PATENT DOCUMENTS

| | | | | |
|---|---|---|---|---|
| 5,607,260 | A | 3/1997 | Khachaturian | |
| 5,609,441 | A | 3/1997 | Khachaturian | |
| 5,662,434 | A | 9/1997 | Khachaturian | |
| 5,706,897 | A | 1/1998 | Horton, III | |
| 5,722,797 | A | 3/1998 | Horton, III | |
| 5,799,603 | A | 9/1998 | Tellington | |
| 5,800,093 | A | 9/1998 | Khachaturian | |
| 5,873,416 | A | 2/1999 | Horton, III | |
| 5,924,822 | A | 7/1999 | Finn et al. | |
| 5,931,602 | A | 8/1999 | Gulbrandsen et al. | |
| 5,975,807 | A | 11/1999 | Khachaturian | |
| 6,012,873 | A | 1/2000 | Copple et al. | |
| 6,027,286 | A | 2/2000 | Pollack | |
| 6,039,506 | A | 3/2000 | Khachaturian | |
| 6,149,350 | A | 11/2000 | Khachaturian | |
| 6,318,931 | B1 | 11/2001 | Khachaturian | |
| 6,364,574 | B1 | 4/2002 | Khachaturian | |
| 6,367,399 | B1 | 4/2002 | Khachaturian | |
| 6,435,773 | B1 * | 8/2002 | Khachaturian | 405/202 |
| 6,435,774 | B1 * | 8/2002 | Khachaturian | 405/202 |
| 6,692,190 | B2 | 2/2004 | Khachaturian | |
| 6,719,495 | B2 | 4/2004 | Khachaturian | |
| 7,527,006 | B2 | 5/2009 | Khachaturian | |
| 7,874,403 | B2 * | 1/2011 | Russell | 184/5 |
| 2004/0037651 | A1 | 2/2004 | Khachaturian | |
| 2011/0209875 | A1 * | 9/2011 | Crome et al. | 166/339 |

* cited by examiner

ARTICULATED MULTIPLE BUOY MARINE PLATFORM APPARATUS AND METHOD OF INSTALLATION

CROSS-REFERENCE TO RELATED APPLICATIONS

This is a non provisional patent application of U.S. Provisional Patent Application Ser. No. 61/385,408, filed 22 Sep. 2010.

Priority of U.S. Provisional Patent Application Ser. No. 61/385,408, filed 22 Sep. 2010, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to a method of installing a floating marine platform. More particularly, the present invention relates to a marine platform and a method of installing a marine platform using multiple buoys that support a platform and wherein tensile anchor cables connect to a deck part of the platform at the center of the deck. In one embodiment, an improved buoy construction is provided with longitudinal, transverse and diagonal members (e.g., welded) and having a lower ballast section, upper buoyant section and intermediate neutral buoyancy section.

2. General Background of the Invention

Many types of marine platforms have been designed, patented, and/or used commercially. Marine platforms typically take the form of either fixed platforms that include a large underwater support structure or "jacket" or a floating platform having a submersible support. Sometimes these platforms are called semi-submersible rigs.

Jack-up barges are another type of platform that can be used in an offshore marine environment for drilling/production. Jack-up barges have a barge with long legs that can be powered up for travel and powered down to elevate the barge above the water.

Other types of platforms for deep water (for example, 1500 feet (457.2 meters) or deeper) have been patented such as spars and others. Some of the following patents relate to offshore platforms, some of which are buoy type offshore platforms, all of which are hereby incorporated herein by reference. Other patents have issued that relate in general to floating structures, and including some patents disclosing structures that would not be suitable for use in oil and gas well drilling and/or production. The following Table lists examples of marine platforms. The order of listing is numerical, and is otherwise of no significance.

TABLE

| PATENT # | ISSUE DATE DD/MM/YYYY | TITLE |
|---|---|---|
| 2,952,234 | 13-09-1960 | Sectional Floating Marine Platform |
| 3,540,396 | 17-11-1970 | Offshore Well Apparatus and System |
| 3,982,492 | 28-09-1976 | Floating Structure |
| 4,286,538 | 01-09-1981 | Multipurpose Floating Structure |
| 4,297,965 | 03-11-1981 | Tension Leg Structure for Tension Leg Platform |
| 4,620,820 | 04-11-1986 | Tension Leg Platform Anchoring Method and Apparatus |
| 4,714,382 | 22-12-1987 | Method and Apparatus for the Offshore Installation of Multi-ton Prefabricated Deck Packages on Partially Submerged Offshore Jacket Foundations |
| 5,197,825 | 30-03-1993 | Tendon for Anchoring a Semisubmersible Platform |
| 5,423,632 | 13-06-1995 | Compliant Platform With Slide Connection Docking to Auxiliary Vessel |
| 5,439,060 | 08-08-1995 | Tensioned Riser Deepwater Tower |
| 5,558,467 | 24-09-1996 | Deep Water offshore Apparatus |
| 5,607,260 | 04-03-1997 | Method and Apparatus for the Offshore Installation of Multi-ton Prefabricated Deck Packages on Partially Submerged Offshore Jacket Foundations |
| 5,609,441 | 11-03-1997 | Method and Apparatus for the Offshore Installation of Multi-ton Prefabricated Deck Packages on Partially Submerged Offshore Jacket Foundations |
| 5,662,434 | 02-09-1997 | Method and Apparatus for the Offshore Installation of Multi-ton Prefabricated Deck Packages on Partially Submerged Offshore Jacket Foundations |
| 5,706,897 | 13-01-1998 | Drilling, Production, Test, and Oil Storage Caisson |
| 5,722,797 | 03-03-1998 | Floating Caisson for Offshore Production and Drilling |
| 5,799,603 | 01-09-1998 | Shock-Absorbing System for Floating Platform |
| 5,800,093 | 01-09-1998 | Method and Apparatus for the Offshore Installation of Multi-ton Packages Such as Deck Packages, Jackets, and Sunken Vessels |

TABLE-continued

| PATENT # | ISSUE DATE DD/MM/YYYY | TITLE |
|---|---|---|
| 5,873,416 | 23-02-1999 | Drilling, Production, Test, and Oil Storage Caisson |
| 5,931,602 | 03-08-1999 | Device for Oil Production at Great Depths at Sea |
| 5,924,822 | 20-07-1999 | Method for Deck Installation on an Offshore Substructure |
| 5,975,807 | 02-11-1999 | Method and Apparatus for the Offshore Installation of Multi-ton Packages Such as Deck Packages and Jackets |
| 6,012,873 | 11-01-2000 | Buoyant Leg Platform With Retractable Gravity Base and Method of Anchoring and Relocating the Same |
| 6,027,286 | 22-02-2000 | Offshore Spar Production System and Method for Creating a Controlled Tilt of the Caisson Axis |
| 6,039,506 | 21-03-2000 | Method and Apparatus for the Offshore Installation of Multi-ton Packages Such as Deck Packages and Jackets |
| 6,149,350 | 21-11-2000 | Method and Apparatus for the Offshore Installation of Multi-ton Packages Such as Deck Packages and Jackets |
| 6,318,931 | 20-11-2001 | Method and Apparatus for the Offshore Installation of Multi-ton Packages Such as Deck Packages and Jackets |
| 6,364,574 | 02-04-2002 | Method and Apparatus for the Offshore Installation of Multi-ton Packages Such as Deck Packages and Jackets |
| 6,367,399 | 09-04-2002 | Method and Apparatus for Modifying New or Existing Marine Platforms |
| 6,435,773 | 20-08-2002 | Articulated Multiple Buoy Marine Platform Apparatus and Method of Installation |
| 6,435,774 | 20-08-2002 | Articulated Multiple Buoy Marine Platform Apparatus |
| 6,692,190 | 17-02-2004 | Articulated Multiple Buoy Marine Platform Apparatus |
| 6,719,495 | 13-04-2004 | Articulated Multiple Buoy Marine Platform Apparatus and Method of Installation |
| 7,527,006 | 05-05-2009 | Marine Lifting Apparatus |
| GB 2092664 | 18-08-1982 | Ball-and-Socket Coupling for Use in Anchorage of Floating Bodies |

One of the problems with single floater type marine platform constructions or "spars" is that the single floater must be enormous, and thus very expensive to manufacture, transport, and install. In a marine environment, such a structure must support an oil and gas well drilling rig or production platform weighing between 500 and 40,000 tons (between 454 to 36,287 metric tons), for example (or even a package of between 5,000-100,000 tons (4,536 to 90,718 metric tons)).

BRIEF SUMMARY OF THE INVENTION

The present invention provides an improved offshore marine platform (and method of installation) that can be used for drilling for oil and/or gas or in the production of oil and gas from an offshore environment. Such drilling and/or production facilities typically can weigh between 500-100,000 tons (454-90,718 metric tons), and more commonly weigh between 3,000-50,000 tons (2,722-45,359 metric tons).

The apparatus of the present invention thus provides a marine platform that is comprised of a plurality of spaced apart buoys and a deck having a periphery that includes a plurality of attachment positions, one attachment position for each buoy. An articulating connection joins each buoy to the platform deck or superstructure.

Each of the buoys will move due to current and/or wind and/or wave action or due to other dynamic marine environmental factors. "Articulating connection" as used herein should be understood to mean any connection or joint that connects a buoy to the platform deck or superstructure, transmits axial and shear forces, and allows the support buoy(s) to move relative to the platform deck or superstructure without separation, and wherein the bending movement transferred to the platform deck or superstructure from one of the so connected buoys or from multiple of the so connected buoys is reduced, minimized or substantially eliminated.

"Articulating connection" is a joint movably connecting a buoy to a platform deck or superstructure wherein axial and tangential forces are substantially transmitted, however, transfer of bending movement is substantially reduced or minimized through the joint allowing relative movement between the buoy and the platform deck or superstructure.

An articulating connection connects each buoy to the platform at a respective attachment position, the connection allowing for sea state induced buoy motions while minimizing effects on the platform.

The apparatus of the present invention provides a marine platform that further comprises a mooring extending from the center of the platform to anchor points or anchors for holding the platform and buoys to a desired location.

In one embodiment, the present invention provides a marine platform wherein each of the articulating connections includes corresponding concave and convex engaging portions. In another embodiment, a universal type joint is disclosed.

In another embodiment a marine platform has buoys with convex articulating portions and the platform has correspondingly shaped concave articulating portions.

In one embodiment, each buoy can be provided with a concave articulating portion and the platform with a corresponding convex articulating portion that engages a buoy.

In one embodiment, each buoy has a height and a diameter. In a preferred embodiment, the height is much greater than the diameter for each of the buoys.

In one embodiment, each buoy is preferably between about 25 and 100 feet (7.6 and 30.5 meters) in diameter.

The apparatus of the present invention preferably provides a plurality of buoys. The buoys can be of a truss or lattice construction.

In a preferred embodiment, the platform is comprised of a trussed deck. The trussed deck preferably has lower horizontal members, upper horizontal members and a plurality of inclined members spanning between the upper and lower horizontal members, and wherein the attachment positions are next to the lower horizontal member.

In a preferred embodiment, the apparatus supports an oil and gas well drilling and/or production platform weighing between 500 and 100,000 tons (between 454 and 90,718 metric tons), more particularly, weighing between 3,000 and 50,000 tons (between 2,722 and 45,359 metric tons).

The apparatus of the present invention uses articulating connections between the submerged portion of the buoy and the platform deck or superstructure to minimize or reduce topside, wave induced motions during the structural life of the apparatus.

The apparatus of the present invention thus enables smaller, multiple hull components to be used to support the platform deck or superstructure rather than a single column or single buoy floater.

With the present invention, the topside angular motion is reduced and is less than the topside angular motion of a single column floater of comparable weight.

With the present invention, there is substantially no bending movement or minimum bending movement transferred between each buoy and the structure being supported. The present invention thus minimizes or substantially eliminates movement transfer at the articulating connection that is formed between each buoy and the structure being supported. The buoys are thus substantially free to move in any direction relative to the supported structure or load, excepting motion that would separate a buoy from the supported structure.

The present invention has particular utility in the supporting of oil and gas well drilling facilities and oil and gas well drilling production facilities. The apparatus of the present invention has particular utility in very deep water, for example, in excess of 1500 feet (457 meters).

The present invention also has particular utility in tropical environments (for example West Africa and Brazil) wherein the environment produces long period swell action.

The present invention provides a method of installing an oil and gas well facility such as a drilling facility or a production facility on a platform in an offshore deepwater marine environment. The term "deepwater" as used herein means water depths of in excess of 1500 feet (457 meters).

The method of the present invention contemplates the placement of a plurality of buoys at a selected offshore location, a portion of each of the buoys being underwater. A platform deck or superstructure extends above water and includes a platform having an oil and gas well facility. Such a facility can include oil well drilling, oil well production, or a combination of oil well drilling and production. The platform and its facility can be floated to a selected location. The platform includes a peripheral portion having a plurality of attachment positions, one attachment position for each buoy.

When the buoys and platform are located at a desired position, the platform is ballasted relative to the buoys until the buoys connect with the platform. This connection can be achieved by either ballasting the platform downwardly (such as for example, using a ballasted transport barge), or by ballasting the buoys to a higher position so that they engage the supported platform.

The platform can include a trussed deck that carries at or near its periphery or corners, connectors that enable a connection to be formed with the upper end portion of each buoy. As an example, there can be provided four buoys and four connectors on the trussed deck or platform.

If a trussed deck is employed, an oil well production facility (drilling or production or a combination) can be supported upon the trussed deck. The connector at the top of each buoy can be any type of an articulating connection that forms an articulation with the trussed deck or a connector on the trussed deck. In an alternate method, the multiple buoys can be used as part of an installation method to place the marine platform upon a single spar support.

The apparatus of the present invention includes a marine platform, comprising a plurality of individual buoys, a platform structure having a central portion and a peripheral portion, a plurality of articulating connections, a separate articulating connection connecting each buoy to a platform deck or superstructure at a respective connecting position, wherein each articulating connection is a separate joint movably connecting a buoy to the platform deck or superstructure, and wherein axial and tangential forces are substantially transmitted without transfer of substantial bending movement, allowing relative movement between each buoy and the structure, and a plurality of mooring lines anchoring the platform structure to a seabed, each mooring line attached to the platform at a position that is spaced inwardly of the buoys.

In one embodiment, each buoy has an upper floatation section, a lower weighted section and a middle spacer section that spaces the upper and lower sections apart.

In one embodiment, the floatation sections each have multiple generally cylindrically shaped sections.

In one embodiment, each buoy upper floatation section is comprised of multiple vertical cylindrical sections joined with multiple transverse sections.

In one embodiment, each buoy has an upper end portion that is generally cylindrically shaped.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

FIGS. 1, 2, 6 and 14-18 show a preferred embodiment of the floating marine platform apparatus (and method) of the present invention designated generally by the numeral 10.

Figure 1:
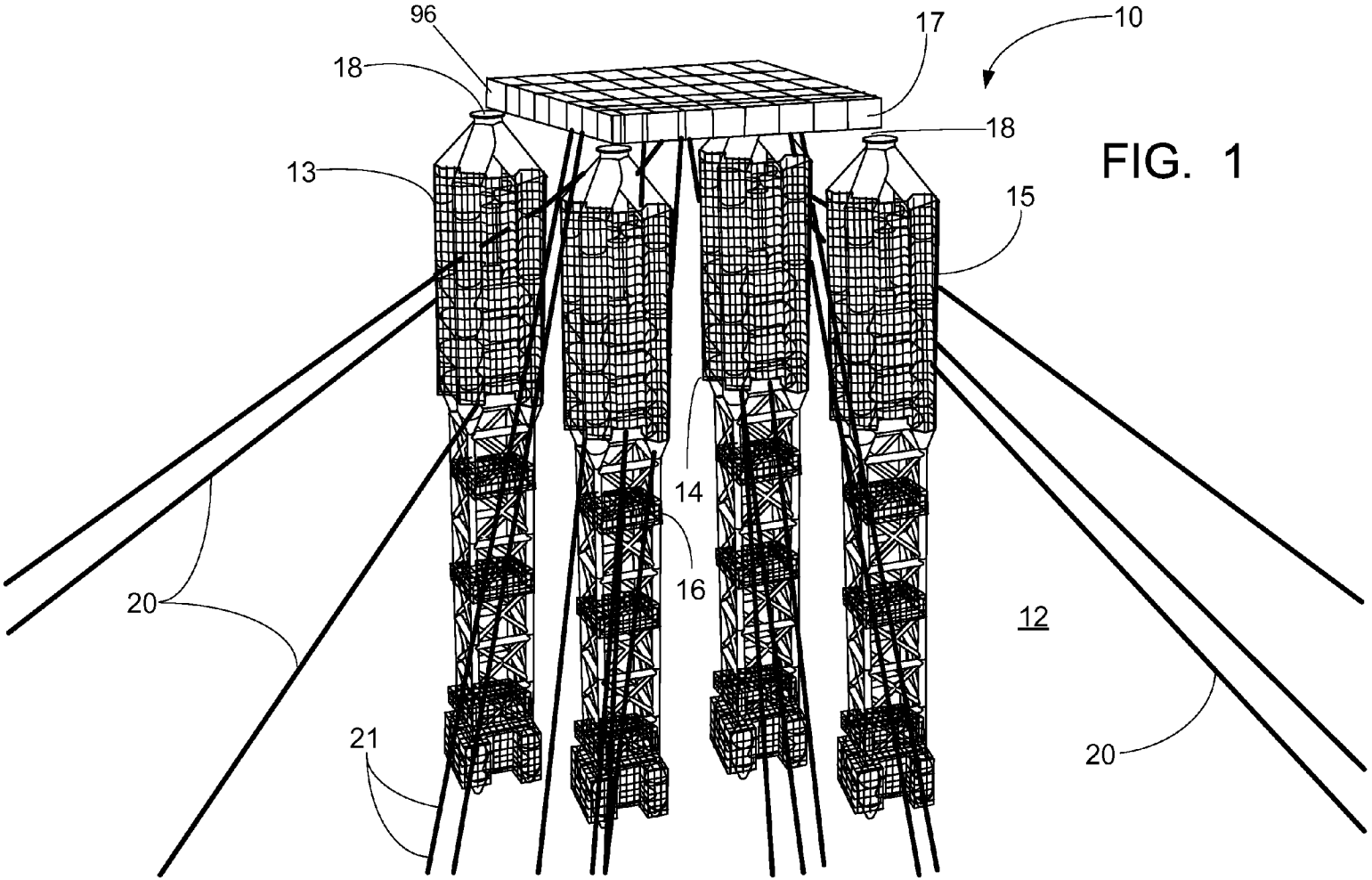
FIG. 1 is a perspective view of a preferred embodiment of the apparatus of the present invention.
Figure 2:
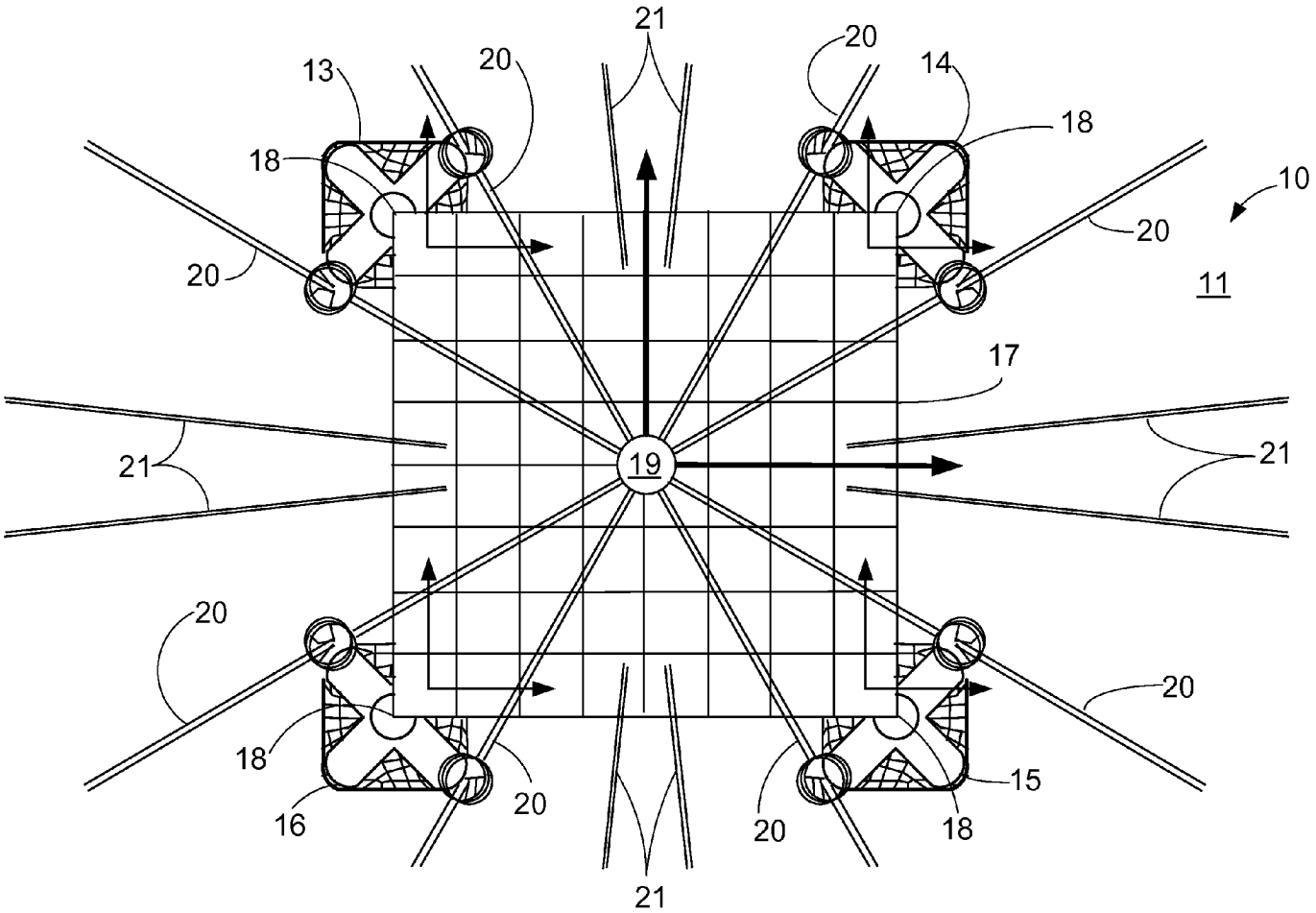
FIG. 2 is a top plane view of a preferred embodiment of the apparatus of the present invention.
Figure 6:
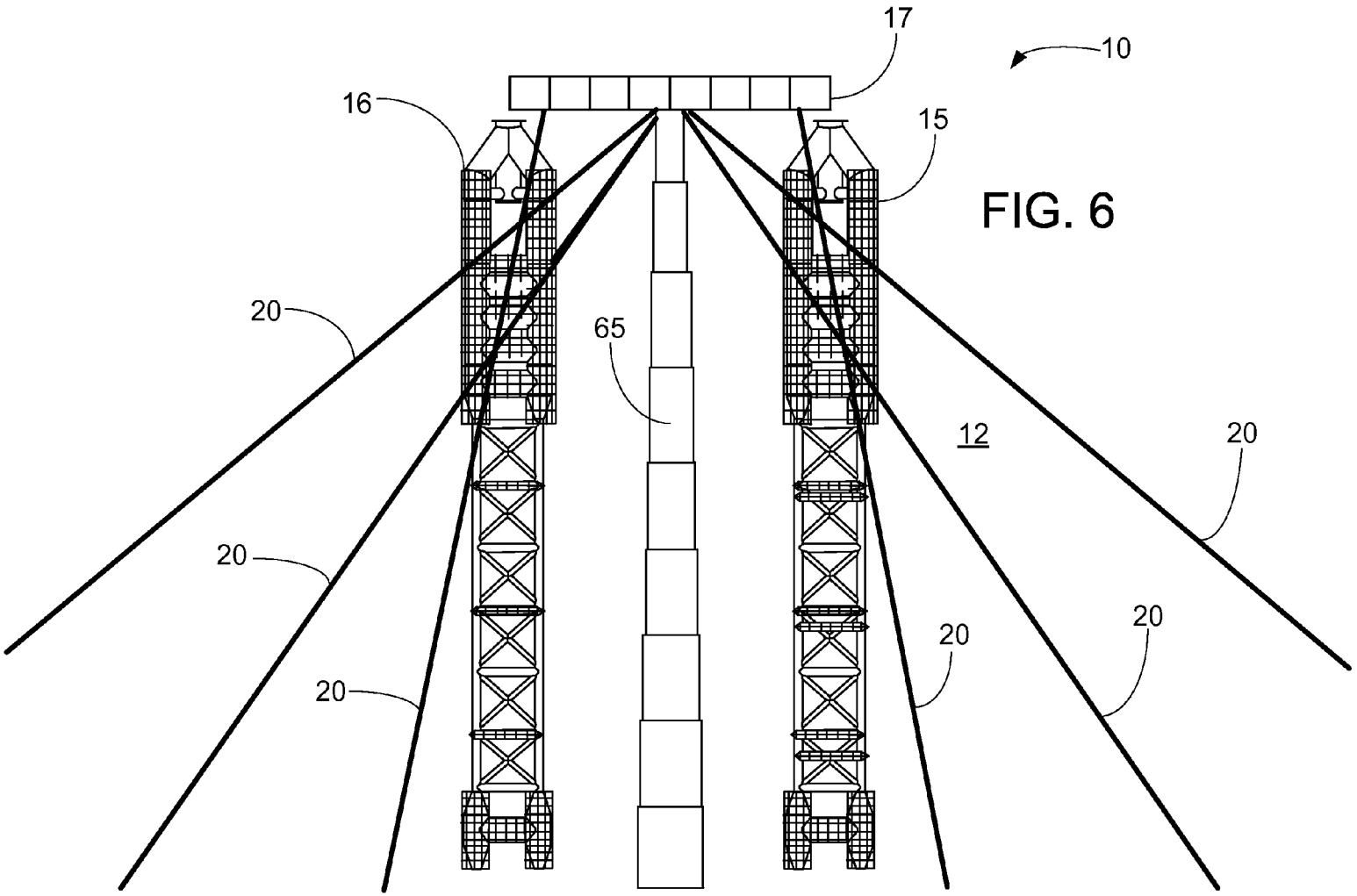
FIG. 6 is an elevation view of a preferred embodiment of the apparatus of the present invention.

In FIGS. 1, 2, 6 and 14-18, the floating marine platform apparatus 10 of the present invention is shown, which is designed to float upon a water surface 11 of an ocean 12, or other deep body of water. The floating marine platform apparatus 10 of the present invention employs four buoys 13, 14, 15, 16. A platform 17 is supported upon the buoys 13, 14, 15, 16. The platform 17 includes a peripheral portion 96 having a plurality of attachment positions, one attachment position for each buoy 13, 14, 15, 16. An articulating connection 18 is provided atop each buoy 13, 14, 15, 16 that interfaces the platform 17 with each buoy 13, 14, 15, 16. Such a connection 18 between a buoy 13, 14, 15 or 16 and a platform 17 can be seen in prior U.S. Pat. Nos. 6,425,710, 6,435,773, 6,435,774, 6,692,190 and 6,719,495, each of which is incorporated herein by reference. Platform 17 provides a central load transfer portion 19 to which are attached multiple anchor lines or mooring lines 20. Other anchor lines or mooring lines 21 can be provided which do not attach to central portion 19. Anchor lines or mooring lines 20, 21 can be attached to platform 17 at a position that is spaced inwardly of the buoys 13, 14, 15 or 16. This arrangement of anchor lines 20, 21 is best seen in FIGS. 2 and 6. FIGS. 19-22 show an interface between a selected anchor 20 or 21 and platform central portion 19.

The present invention provides buoys 13, 14, 15, 16 of improved configuration. The buoys 13, 14, 15, 16 are shown in a side view of each of the FIGS. 3-5. The buoy 13 will be described with respect to FIGS. 3 and 5. Each of the buoys 13, 14, 15, 16 are similarly configured. An alternate buoy arrangement 22 is shown in FIG. 4. It should be understood that each of the buoys 14, 15, 16 can be the same identical configuration as the buoy 13 shown in FIGS. 3, 5. It should also be understood that buoy 22 in FIG. 4 could be substituted in place of any or all of the buoys 13, 14, 15, 16.

Each of the buoys 13, 22 provides an upper buoyant floatation portion 23, a lower ballast portion 24 and a central neutrally buoyant portion 25 which can be flooded. In FIG. 4, the buoy 22 provides floatation bouyant portion 26, ballast portion 27 and neutrally buoyant portion 28.

Figure 3:
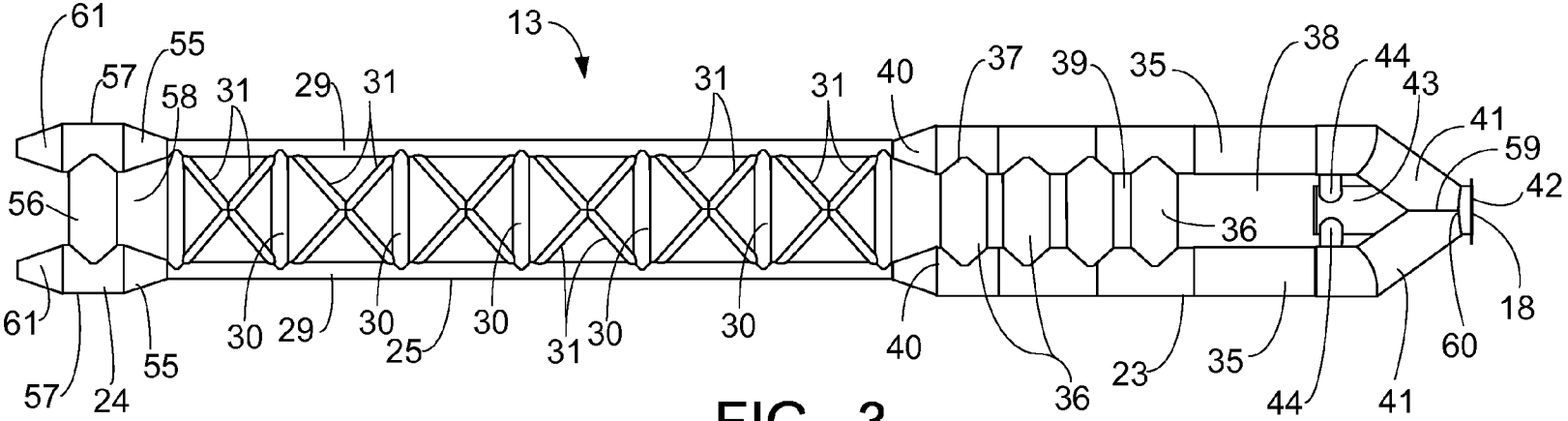
FIG. 3 is a partial side view of a preferred embodiment of the apparatus of the present invention illustrating one of the buoys.
Figure 4:
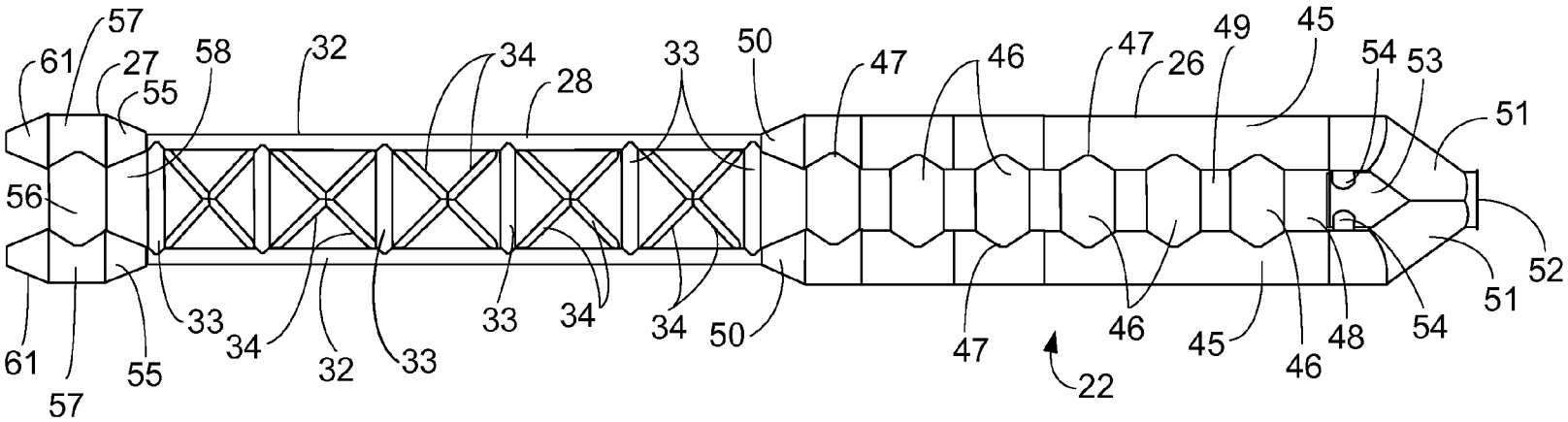
FIG. 4 is a partial side view of a preferred embodiment of the apparatus of the present invention illustrating one of the buoys.
Figure 5:
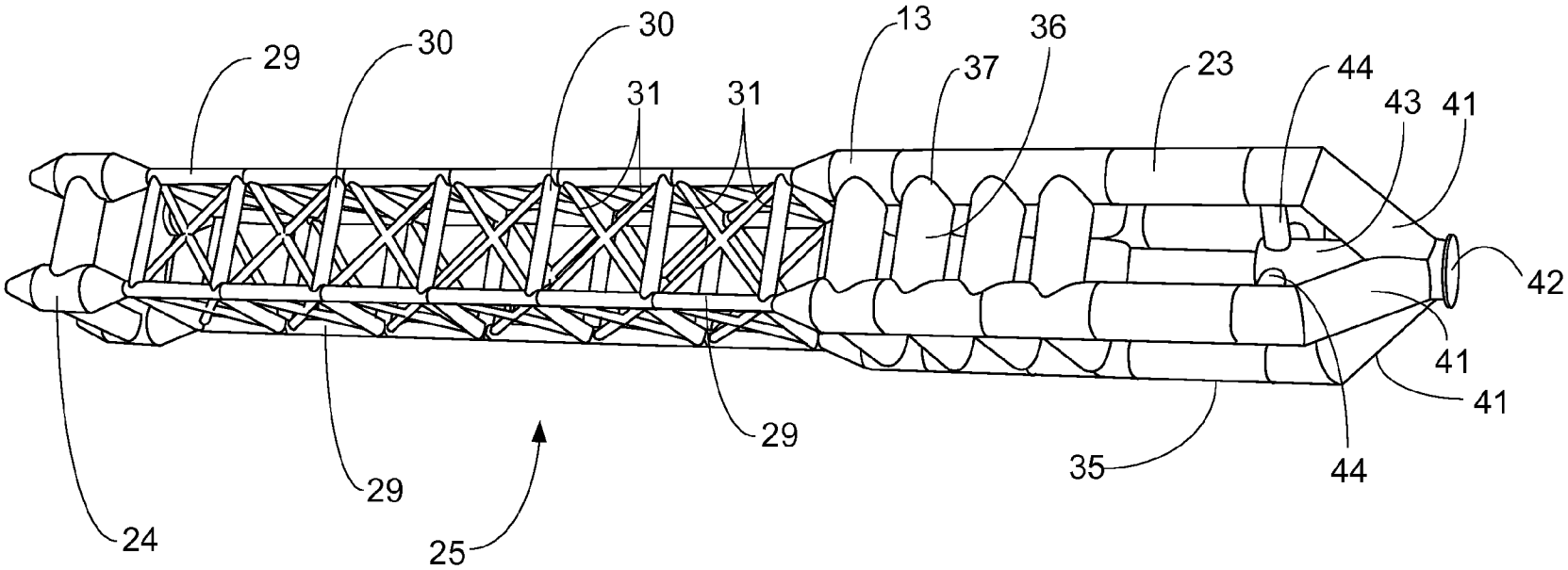
FIG. 5 is a partial side perspective view of a preferred embodiment of the apparatus of the present invention illustrating one of the buoys.

In FIGS. 3 and 5, the neutrally buoyant section 25 can be comprised of longitudinally extending corner members 29, transverse members 30 and diagonally extending members 31. Transverse members 30 span between a pair of corner members 29. Diagonally extending members 31 likewise extend diagonally between corner members 29. The diagonally extending members 31 can connect to transverse members 30.

In FIG. 4, the buoy 22 neutrally buoyant portion 28 can be comprised of longitudinally extending corner members 32, transverse members 33, and diagonally extending members 34. The diagonally extending members 34 can extend diagonally between corner members 32 and can contact transverse members 33.

The upper floatation or buoyant portion 23 of buoy 13 can be comprised of a plurality (for example, four) longitudinally extending corner members 35 which are connected with transverse members 36 at joints or welds 37 (see FIG. 3). Members or sections 35 can be generally cylindrically shaped as seen in FIG. 5. This arrangement produces gaps at 38, 39 between the transverse members 36 as well as between a transverse member 36 and the plurality of diagonally extending portions 41. Tapered sections 40 (which can be frustoconically shaped) join each longitudinally extending corner member 35 of a buoy 13 upper floatation buoyant portion 23 to a corner member 29 of the neutrally buoyant portion 25 of buoy 13. A fitting 42 can be part of the articulating connection 18. Each of the diagonally extending portions 41 is joined at connections 59, 60 (e.g., welds) to fitting 42. A central member 43 extends downwardly from the plurality of diagonally extending portions 41. The central member 43 can be an extension of fitting 42. Radially extending supports 44 extend between a longitudinally extending corner member 35 and central member 43 as shown in FIG. 3.

In FIG. 4, the buoy 22 likewise includes a plurality of longitudinally extending corner members 45 that are a part of floatation or buoyant portion 26. Transverse members 46 span between corner members 45 as shown. Joints or welds 47 form a connection between each transverse member 46 and a corner member 45. Gaps or spaces 49 are provided between each pair of transverse members 46. A space or gap 48 is provided in between an uppermost of the transverse members 46 and central member 53. Tapered sections 50 can be frustoconically shaped. The tapered sections 50 form a joint between each longitudinally extending corner member 45 of floatation or buoyant portion 26 and a corner member 32 of neutrally buoyant portion 28 as shown in FIG. 4. In FIG. 4, diagonally extending portions 51 extend from each longitudinally extending corner column member 45. Fitting 52 can be a part of central member 53. Radially extending supports 54 extend between each longitudinally extending corner member 45 and central member 53.

Each of the ballast sections or ballast portions 24, 27 can be similarly configured. Each ballast section 24 or 27 can include longitudinally extending corner members 57, transverse members 56, and tapered sections 55 (see FIGS. 3, 4). The tapered sections 55 can be frustoconically shaped and join the longitudinal corner member 57 with the corner member 29, 32 of neutrally buoyant portion 25, 28. This arrangement produces gaps 58 between tapered sections 55. Opposite tapered portion 55 is another tapered section 61 which forms the lowermost portion of buoy 13, 22. In FIG. 6, a cental support 65 can be provided extending downwardly from the central portion 19 of platform 17 (see also FIGS. 7-9).

Figure 7:
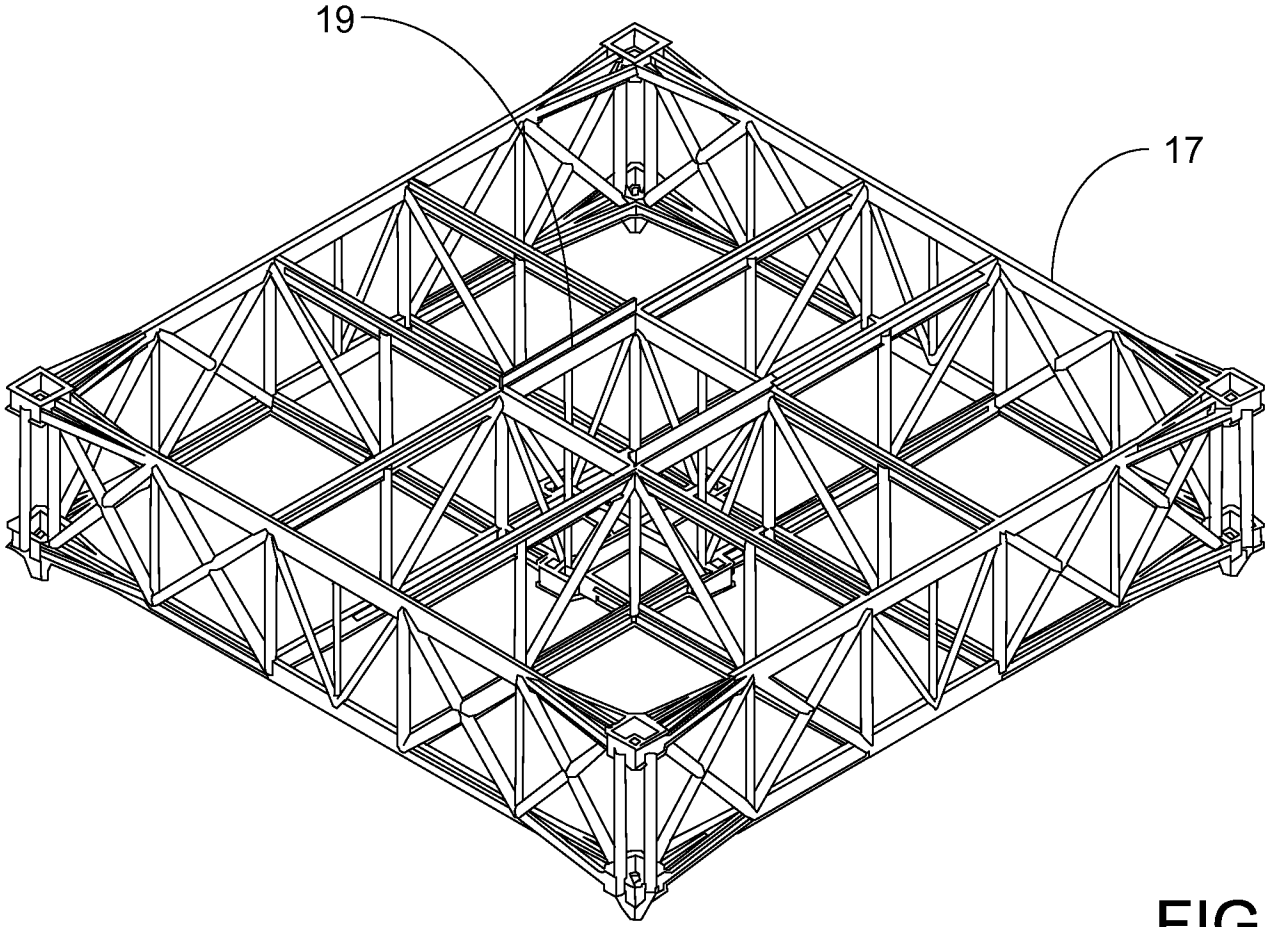
FIG. 7 is a partial perspective view of a preferred embodiment of the apparatus of the present invention.
Figure 8:
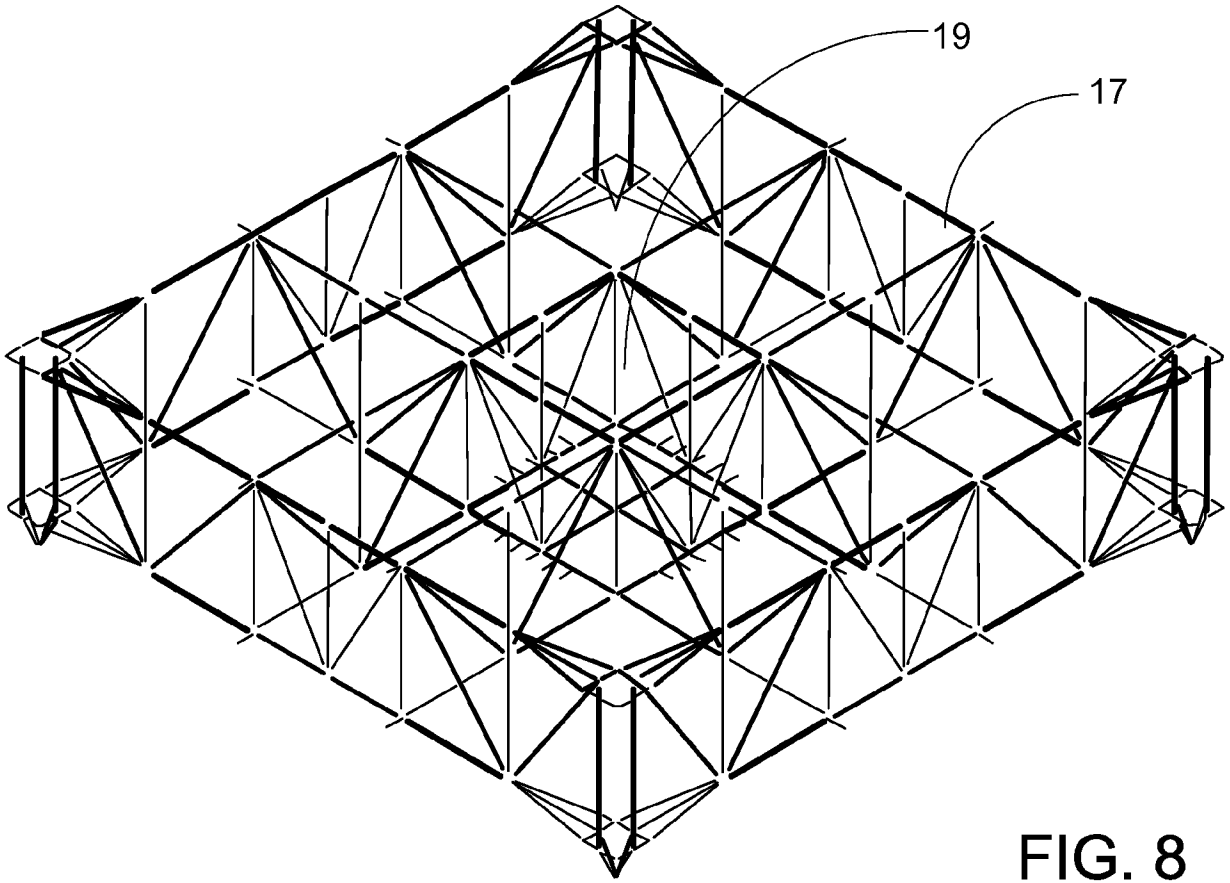
FIG. 8 is a partial perspective view of a preferred embodiment of the apparatus of the present invention.
Figure 9:
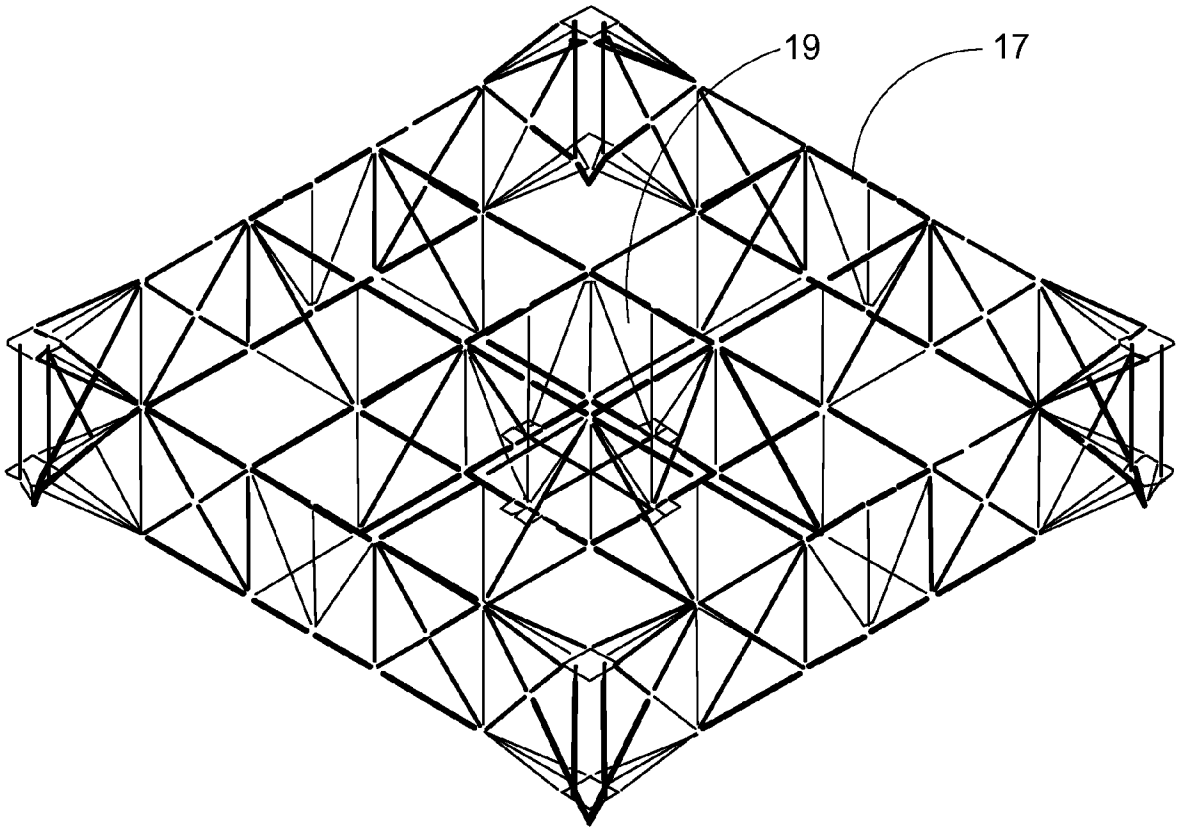
FIG. 9 is a partial perspective view of a preferred embodiment of the apparatus of the present invention.
Figure 10:
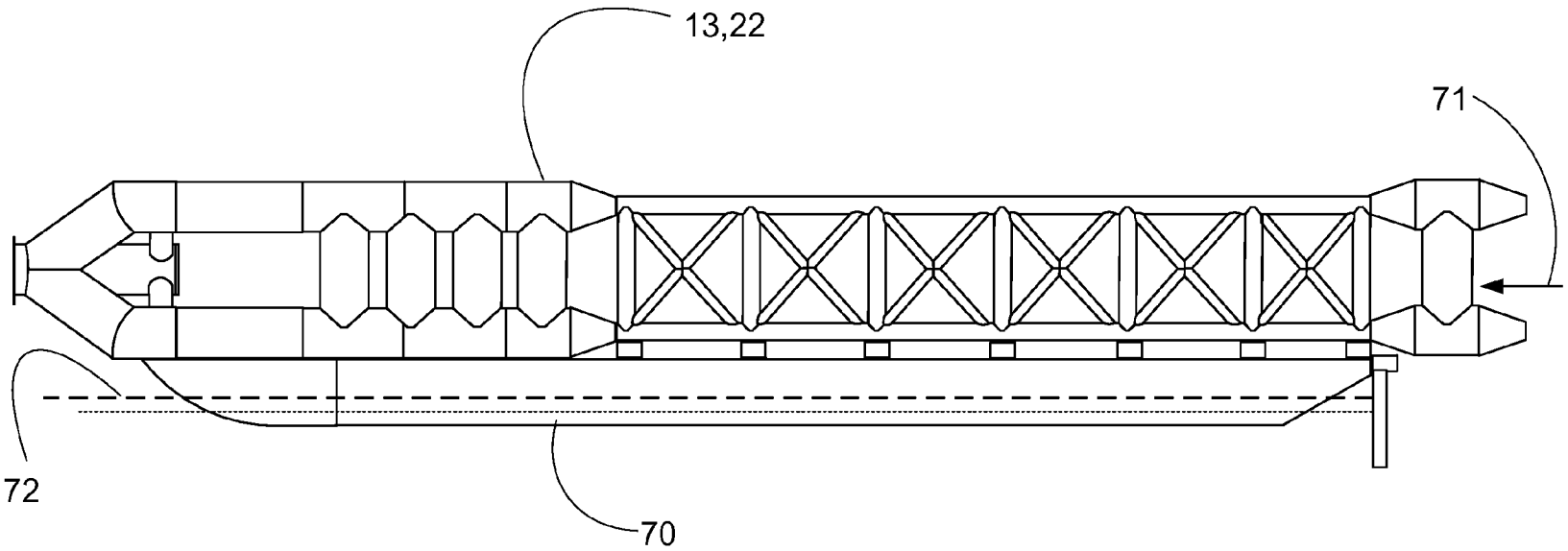
FIG. 10 is an elevation, side view illustrating the apparatus and the method of the present invention.
Figure 11:
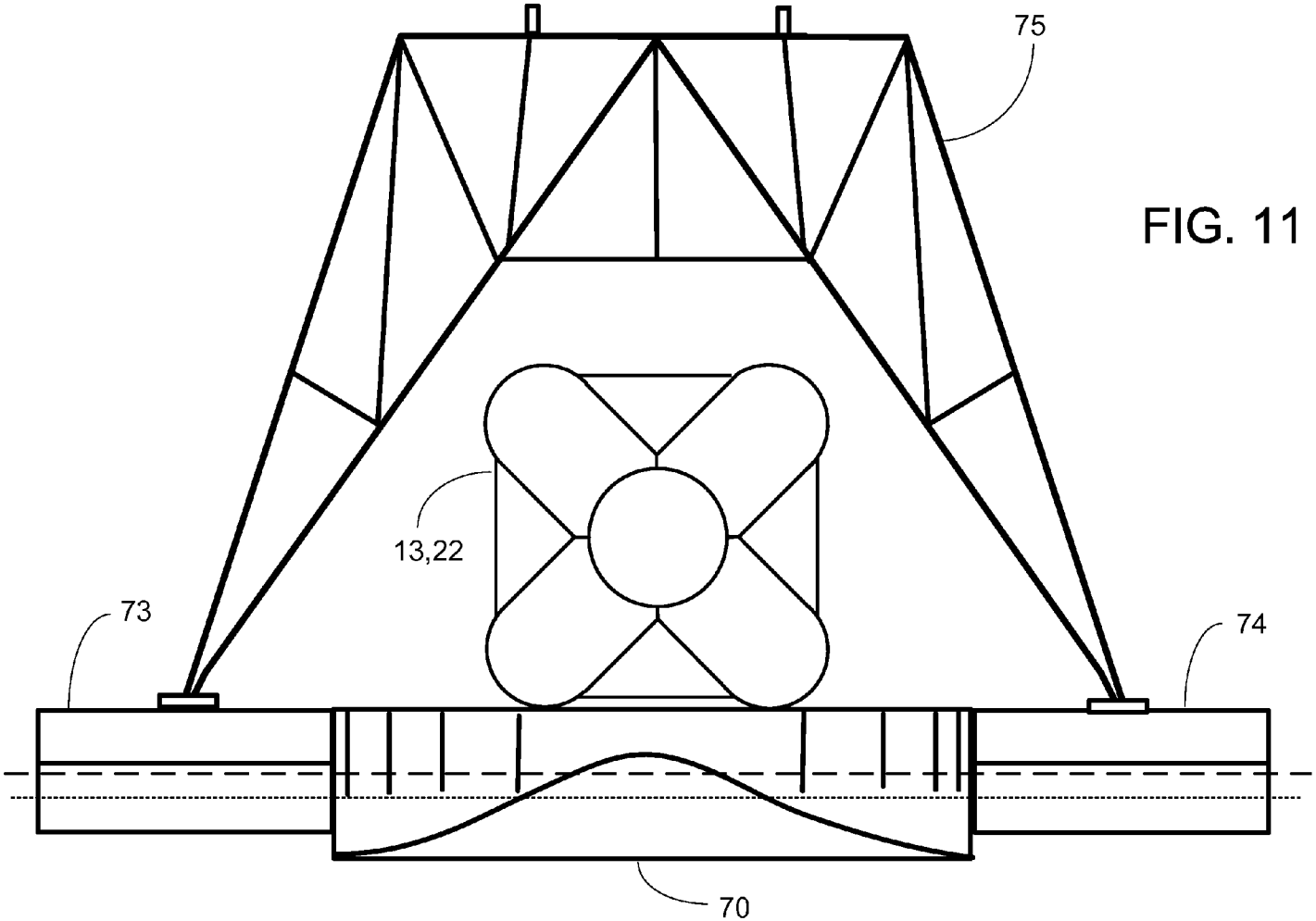
FIG. 11 is an end view illustrating the method of the present invention.
Figure 12:
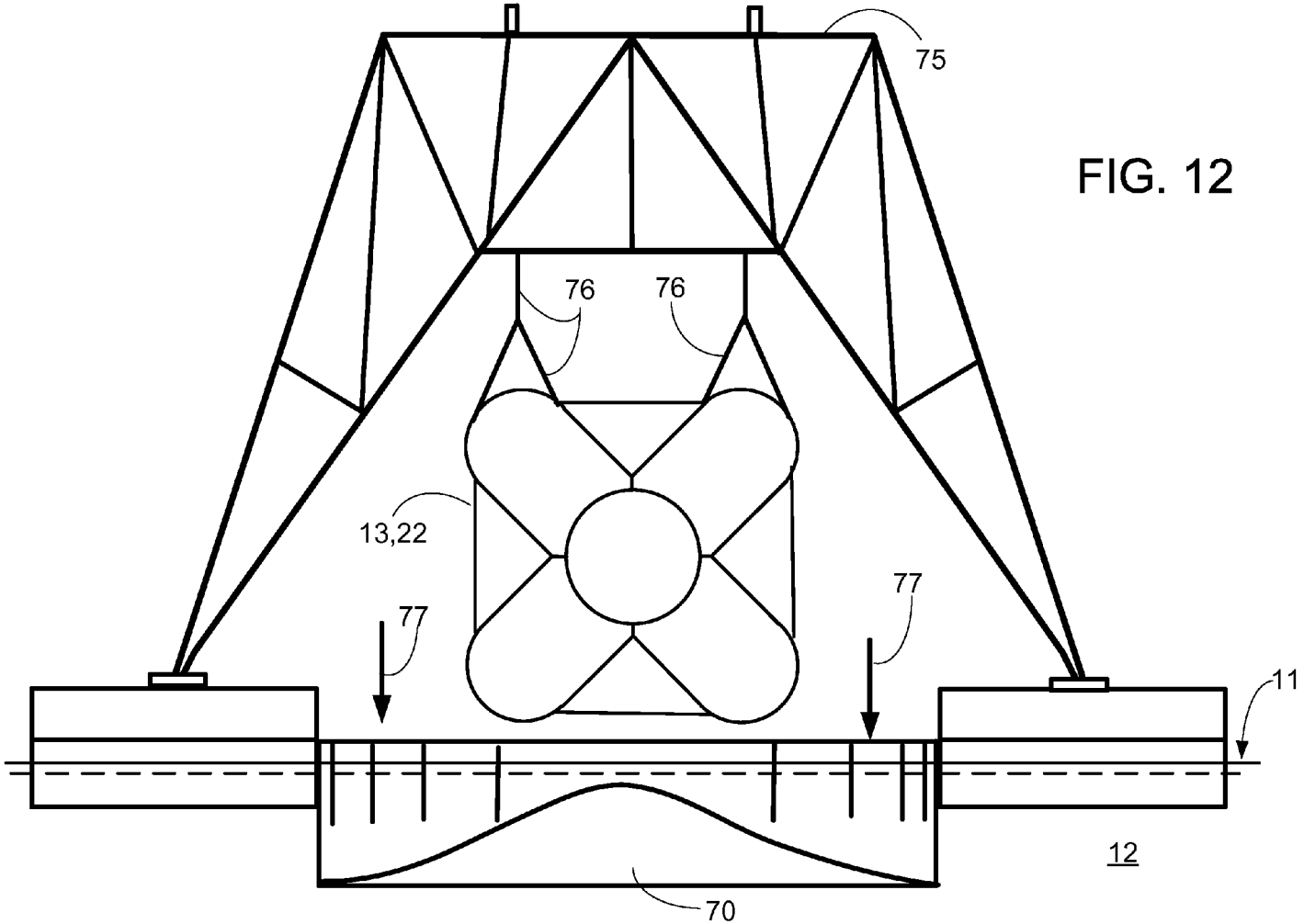
FIG. 12 is an end view illustrating the method of the present invention.

FIGS. 7-9 show more particularly the construction of platform 17 and its central portion 19. Platform 17 can be a truss as shown. FIGS. 10-18 illustrate the method and apparatus of the present invention. In FIG. 10, a vessel 70 is shown carrying a buoy 13, 22 or 14, 15, 16 to a selected local. In FIG. 10, arrow 71 illustrates the direction of travel of the vessel 70 upon a water surface 72. FIG. 11 illustrates the placement of vessel 70 in between a pair of hulls 73, 74 which support one or more lifting frames 75. U.S. Pat. No. 7,527,006, incorporated herein by reference shows such a marine lifting apparatus that employs a pair of hulls such as 73, 74 and one or more lifting frames 75. In FIG. 12, lifting frame or frames 75 lift buoy 13 or 22 using lifting lines/rigging 76. The hull 70 can be ballasted downwardly as indicated by arrows 77 to facilitate its removal from a position under buoys 13 or 22.

Figure 13:
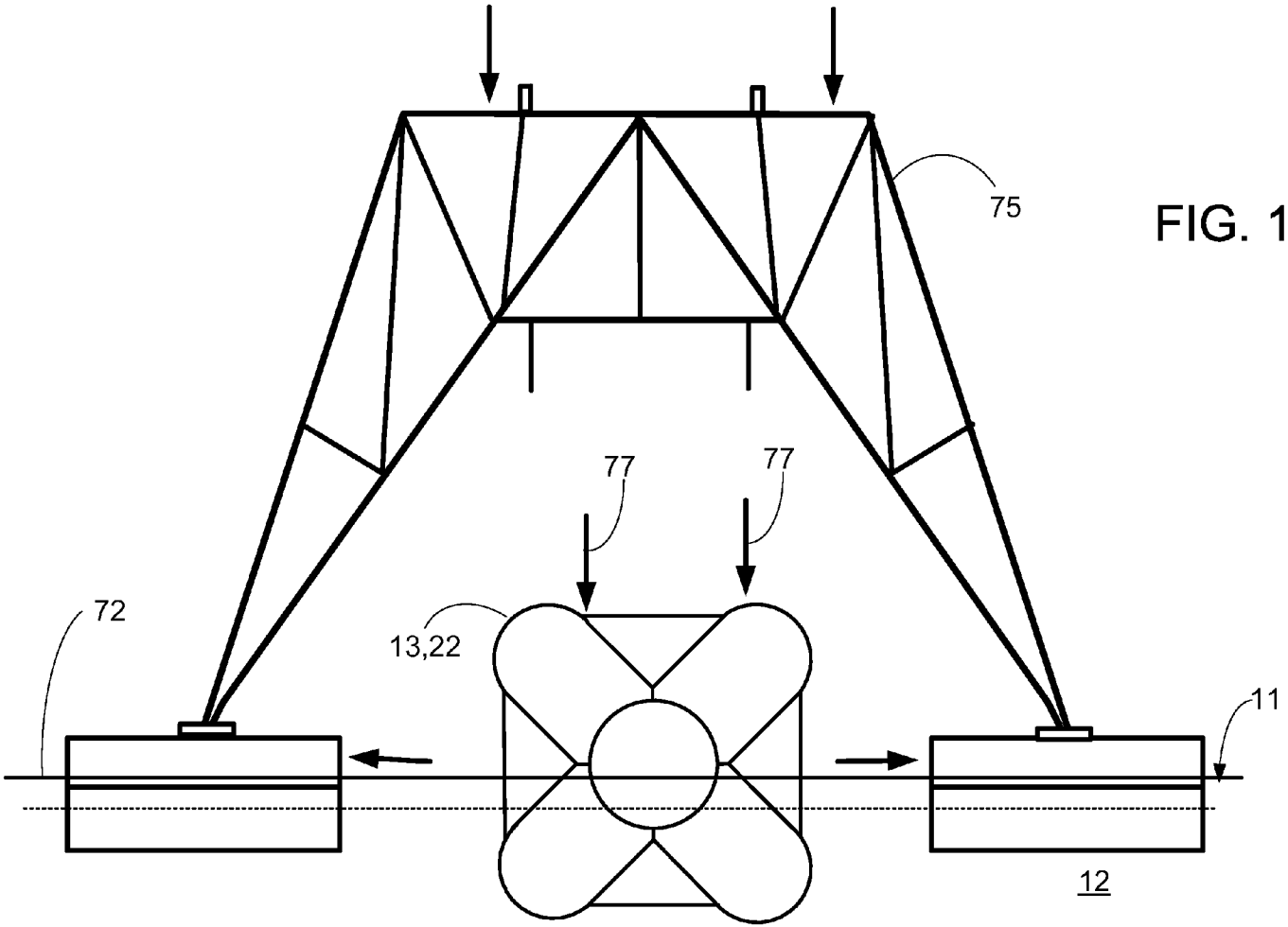
FIG. 13 is an end view illustrating the method of the present invention.

In FIG. 13, the buoy 13 or 22 is lowered to the water's surface 72 as illustrated by arrows 77. Once each buoy 13, 14, 15, 16 is so transported using the method of the present invention, each buoy can be partially flooded at its neutrally buoyant portion 25 or 28 (see FIGS. 3, 4). Each ballast portion 24 or 27 can be filled with ballast material such as lead, steel or other material which is heavy in water, not neutrally buoyant.

Figure 14:
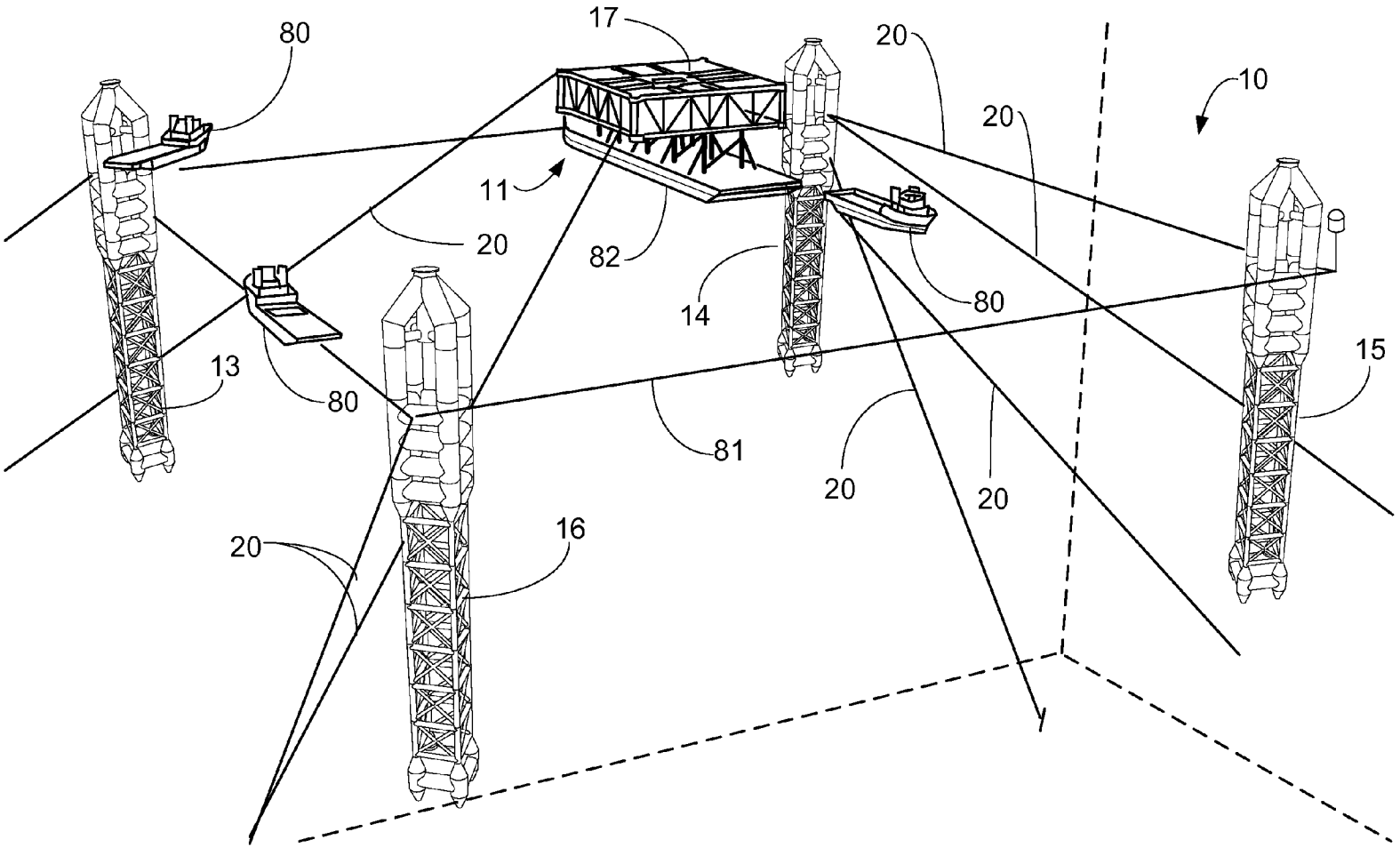
FIG. 14 is a perspective view illustrating the method of the present invention and the apparatus of the present invention.
Figure 15:
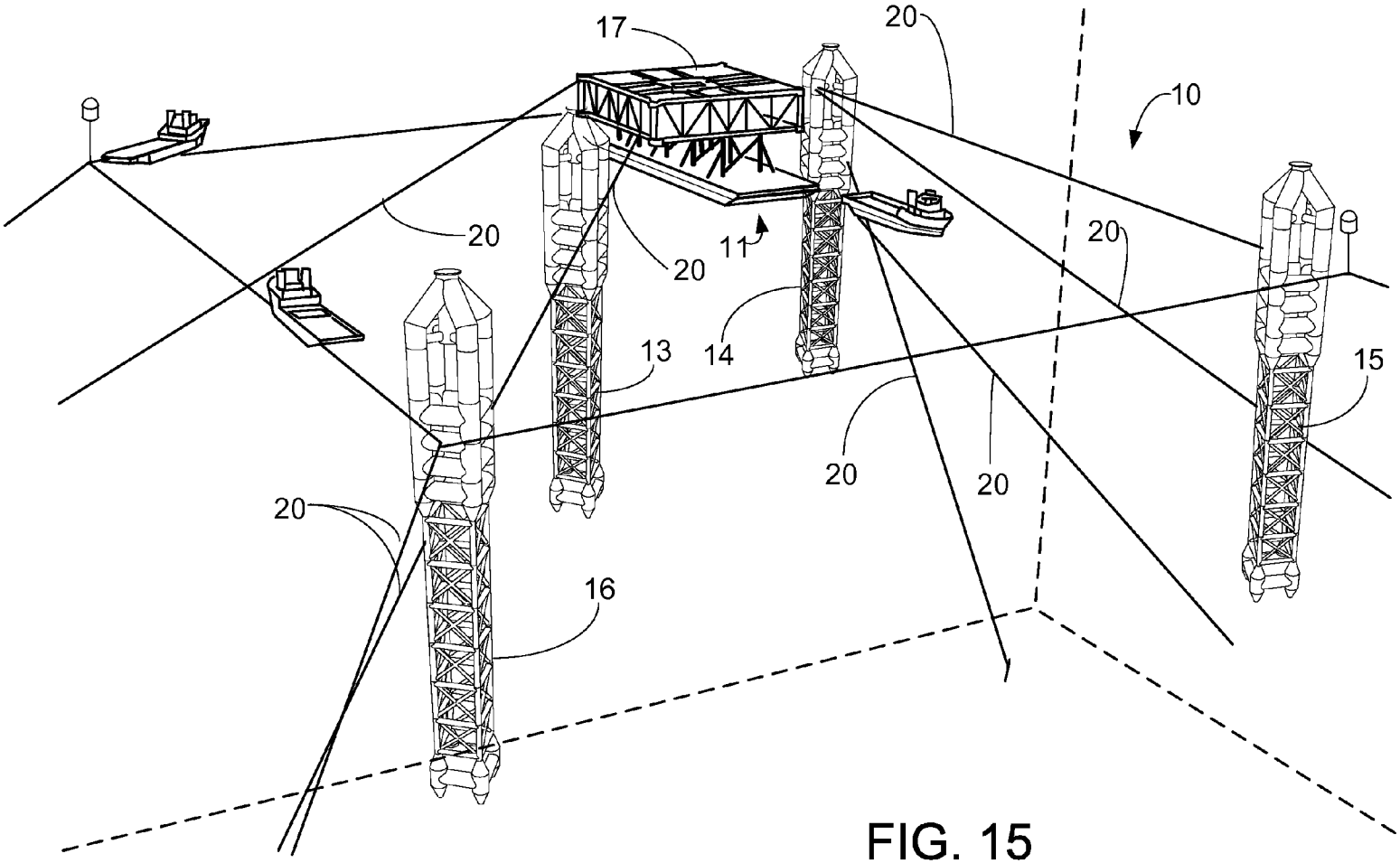
FIG. 15 is a perspective view illustrating the method of the present invention and the apparatus of the present invention.
Figure 16:
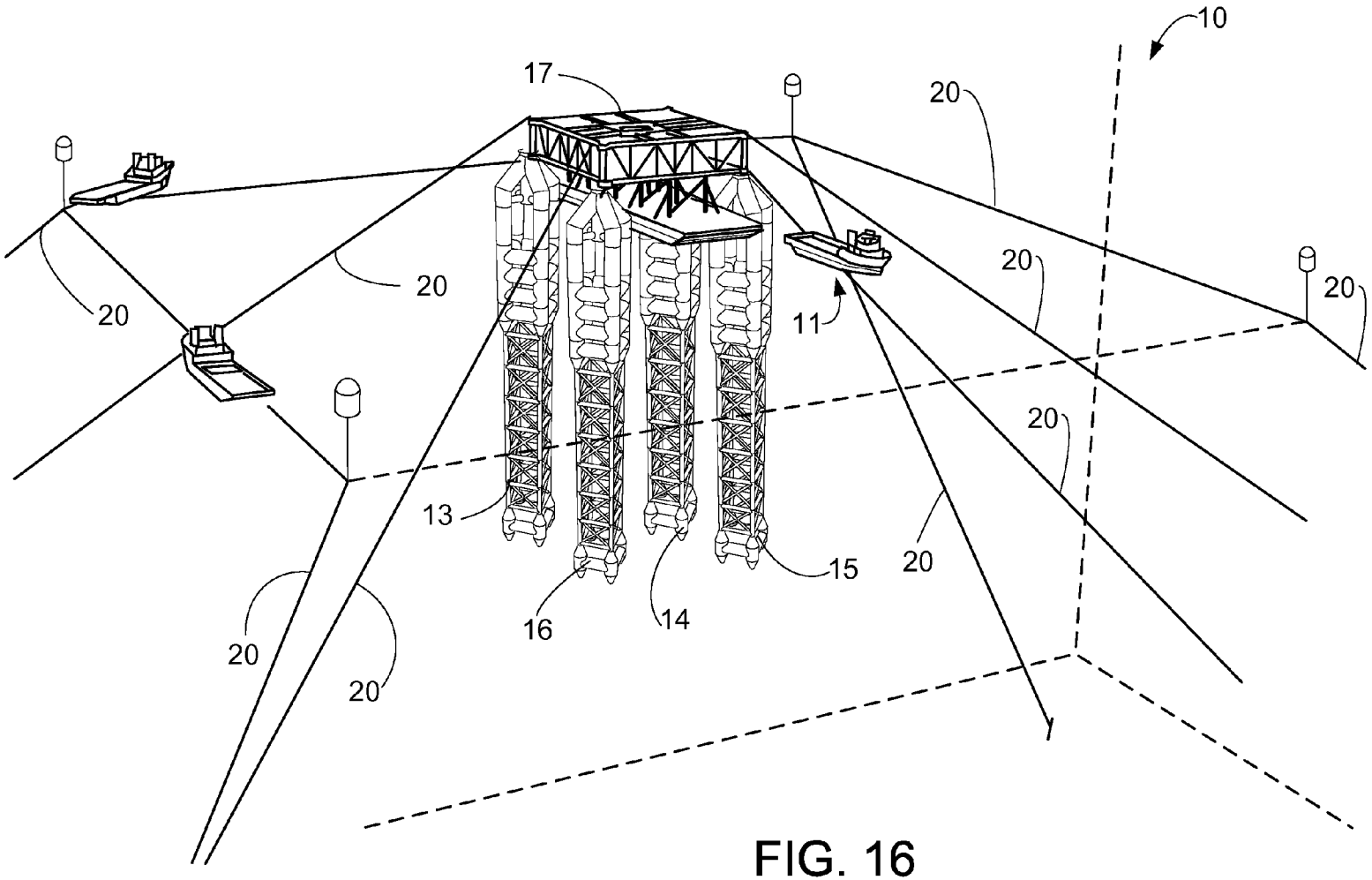
FIG. 16 is a perspective view illustrating the method of the present invention and the apparatus of the present invention.

In FIG. 14, the buoys 13, 14, 15, 16 are positioned using work boats 80 and held in position using anchor ropes and rigging 81. Platform 17 can be transported to the selected location near the buoys 13, 14, 15, 16 as shown in FIG. 14, 15. Platform 17 can be transported upon vessel 82 (see FIG. 17). In FIG. 16, each of the buoys 13, 14, 15, 16 can be placed next to the platform 17, each buoy 13, 14, 15, 16 being aligned with a corner of the platform 17 and a connection formed between each buoy 13, 14, 15, 16 and platform 17 which is an articulating connection 18 (see FIGS. 1 and 2).

Figure 17:
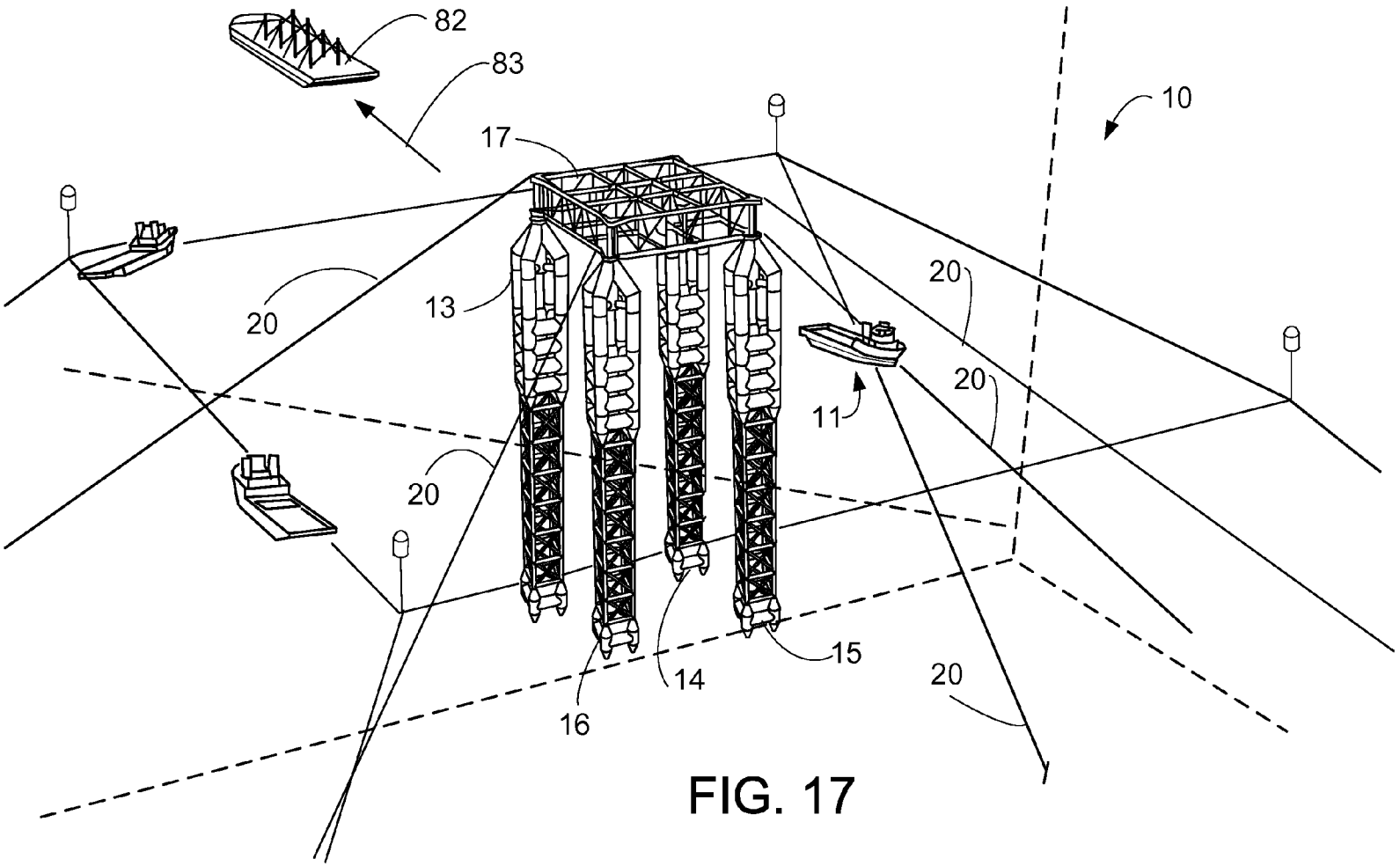
FIG. 17 is a perspective view illustrating the method of the present invention and the apparatus of the present invention.
Figure 18:
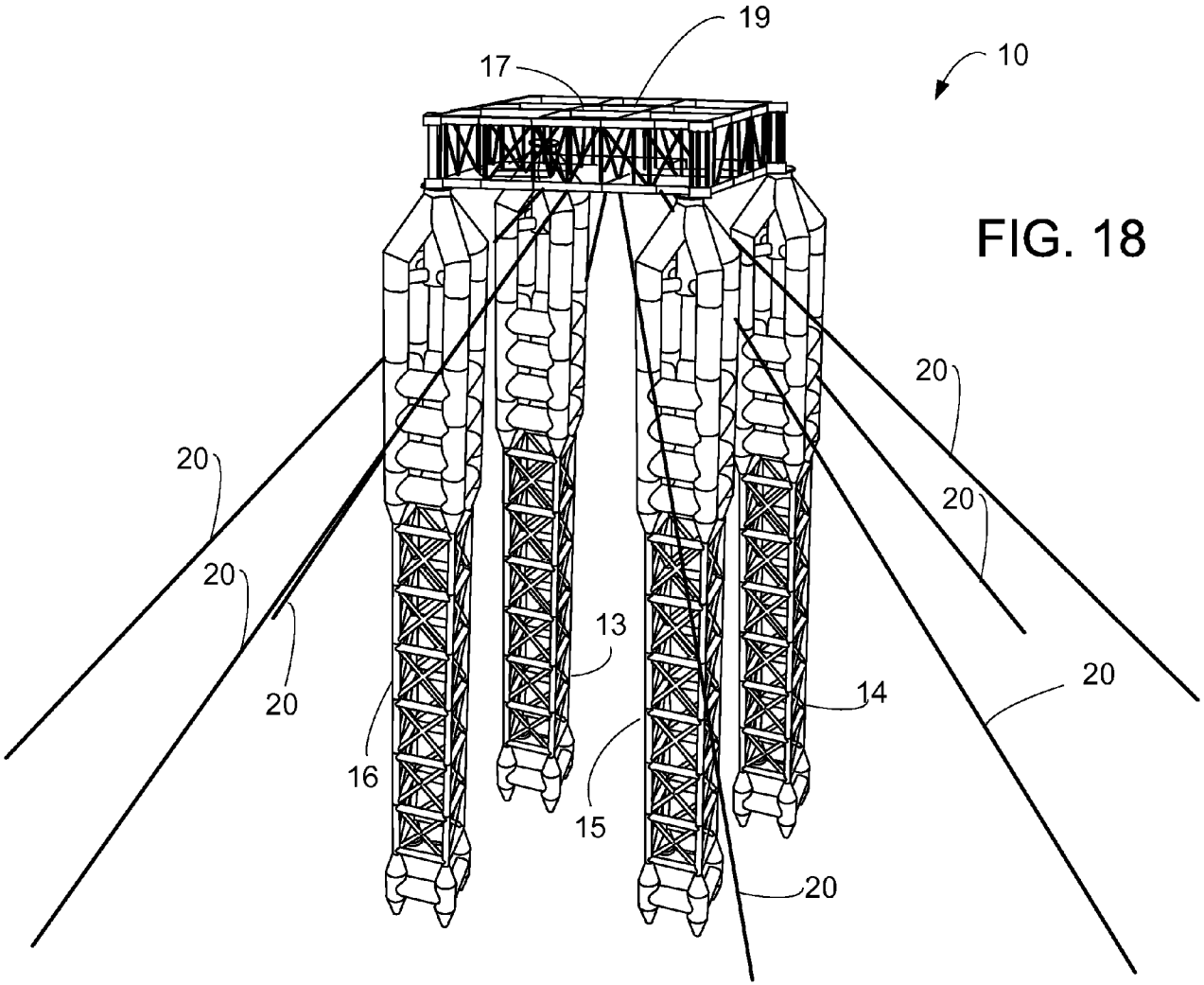
FIG. 18 is a perspective view illustrating the method and apparatus of the present invention and a preferred embodiment of the apparatus of the present invention.

In FIG. 17, the vessel 82 is removed as illustrated by arrow 83. In FIG. 18, the platform 17 and buoys 13, 14, 15, 16 are maintained at a selected local using anchor lines 20, each anchor line 20 forming a connection with the central portion 19 of the platform 17.

Figure 20:
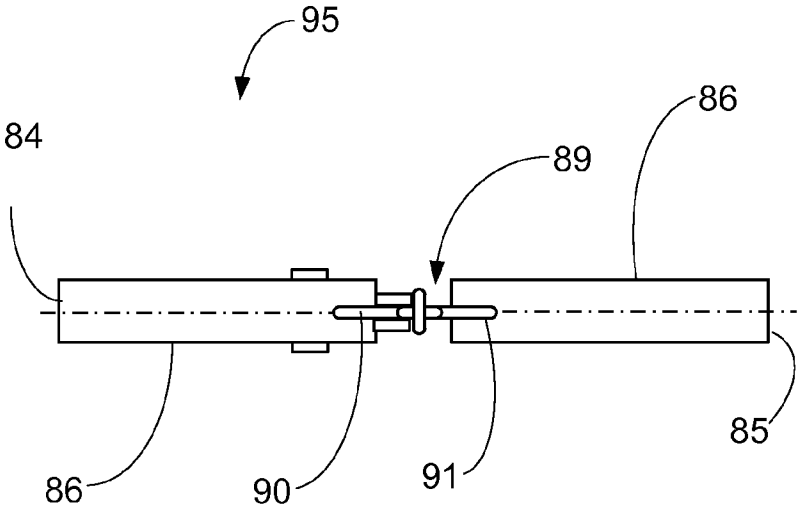
FIG. 20 is a partial plan view of a preferred embodiment of the apparatus of the present invention.
Figure 19:
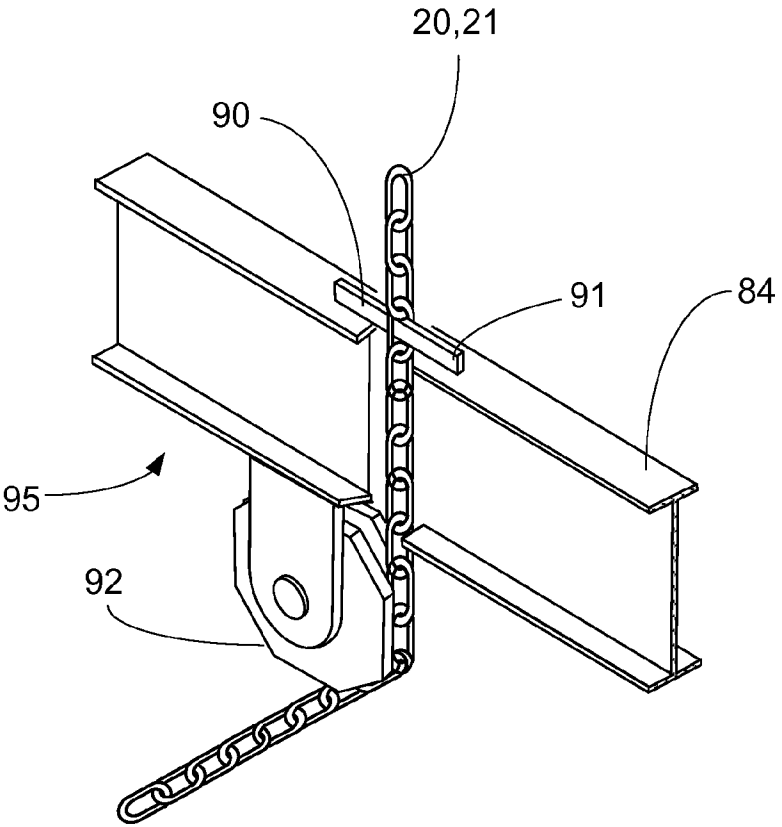
FIG. 19 is a fragmentary perspective view of a preferred embodiment of the apparatus of the present invention.
Figure 22:
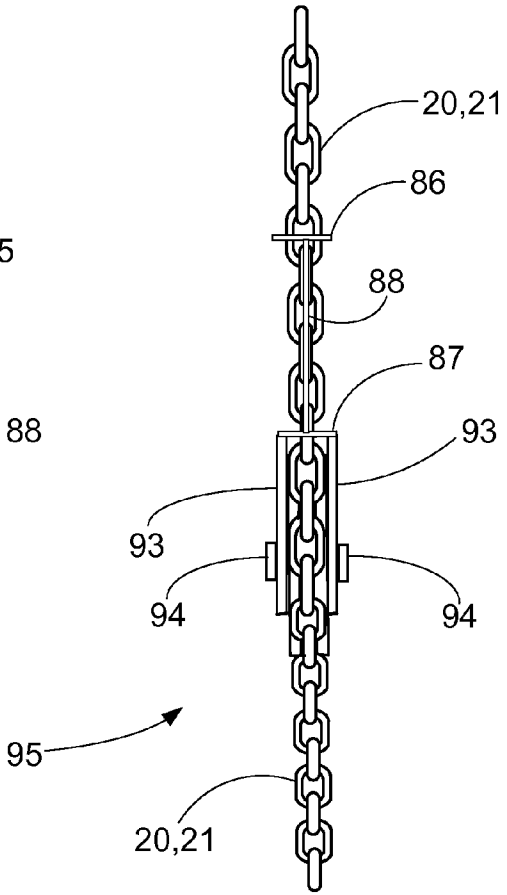
FIG. 22 is a partial end view of a preferred embodiment of the apparatus of the present invention.
Figure 21:
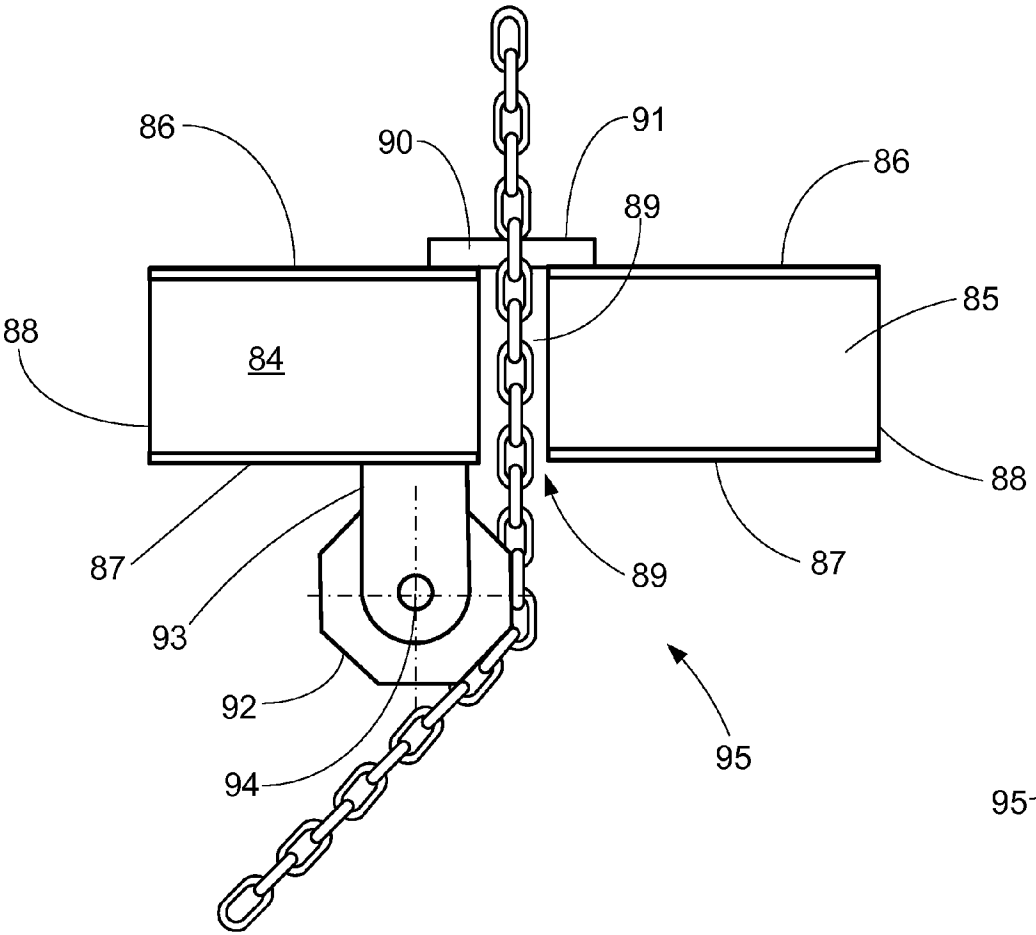
FIG. 21 is a partial side view of a preferred embodiment of the apparatus of the present invention.

FIGS. 19-22 show an interface device 95 that connects each cable 20 or 21 to the platform 17 central portion 19. As an example, there could be between about eight (8) and twelve (12) cables 20 or 21. Platform 17 central portion 19 provides a number of beams 84, 85 welded together as part of a grid or structure or structural portion of platform 17. Each beam 84, 85 is thus attached (e.g. welded) to another beam or beams 84, 85 or to other beams that are part of the platform. Each beam 84, 85 can be a flanged beam, I-beam or wide flanged beam, having a web 88 and spaced apart flanges 86, 87. In FIGS. 19, 20 and 21, there is a gap or space 89 in between beams 84, 85 to accommodate cable 20 or 21 as shown. A pair of chain stoppers or chain chocks 90, 91 are provided. Such chain stoppers or chain chocks can be powered using hydraulic cylinders, pneumatic cylinders, electric motors with linkage or any other actuator which moves the chain stoppers or chain chocks 90, 91 together (closed position) or apart (open position). End portions of the chocks 90, 91 could be shaped to grip the chain when moved to the closed position. When the chain stoppers or chain chocks 90, 91 are powered to move together (closed position), they grip the chain portion of cable 20 or 21 there between thus anchoring the cable 20 or 21 to the platform 17 central portion 19. When the chain stoppers or chain chocks 90, 91 are powered to move apart (open position), they release a grip of the chain portion of cable 20 or 21 thus not anchoring the cable 20 or 21 to the platform 17 central portion 19 (such as when cable 20 or 21 is to be payed out or retrieved).

Central portion 19 of platform 17 would be fitted with one interface device 95 as shown in FIGS. 19-22 for each cable 20 or 21. Central portion 19 could be an area of about 40 square feet equipped with multiple of such devices 95, one for each cable 20 or 21. The chain sheave 92 mounts to shaft 94 which is supported by plates 93 attached (e.g. welded) to a beam 84 (see FIGS. 21, 22). The sheave 92, plates 93, shaft 94 could be located under the deck 17 close to the center of the deck 17 (e.g. on a 40 foot square pattern centered on the deck 17).

Each cable 20 or 21 could include chain and wire or rope or polyester portions. For example, there could be chain on the end that terminates on the chain sheave 92 and chain stoppers or chocks 90, 91. This chain would then connect to a wire rope or polyester rope or both (in a sequence).

PARTS LIST

| PART NUMBER | DESCRIPTION |
|---|---|
| 10 | floating marine platform apparatus |
| 11 | water surface |
| 12 | ocean |
| 13 | buoy |
| 14 | buoy |
| 15 | buoy |
| 16 | buoy |
| 17 | platform |
| 18 | articulating connection |
| 19 | central portion |
| 20 | anchor line/mooring line/cable |
| 21 | anchor line/mooring line/cable |
| 22 | buoy |
| 23 | upper floatation buoyant portion |
| 24 | ballast portion |
| 25 | neutrally buoyant portion |
| 26 | floatation/buoyant portion |
| 27 | ballast portion |
| 28 | neutrally buoyant portion |
| 29 | longitudinal/corner member |
| 30 | transverse member |
| 31 | diagonally extending member |
| 32 | longitudinal/corner member |
| 33 | transverse member |
| 34 | diagonally extending member |
| 35 | longitudinally extending corner member |
| 36 | transverse member |
| 37 | joint/weld |
| 38 | space/gap |
| 39 | space/gap |
| 40 | tapered section |
| 41 | diagonally extending portion |
| 42 | fitting |
| 43 | central member |
| 44 | radial support |
| 45 | longitudinally extending corner member/corner column |
| 46 | transverse member |
| 47 | joint/weld |
| 48 | space/gap |
| 49 | space/gap |
| 50 | tapered section |
| 51 | diagonally extending portion |
| 52 | fitting |
| 53 | central member |
| 54 | radial support |
| 55 | tapered section |
| 56 | transverse member |
| 57 | longitudinally extending corner member/corner column |
| 58 | gap/space |
| 59 | connection |
| 60 | connection |
| 61 | tapered section |
| 65 | central support |
| 70 | vessel |

-continued

| PARTS LIST | |
|---|---|
| PART NUMBER | DESCRIPTION |
| 71 | arrow |
| 72 | water surface |
| 73 | hull |
| 74 | hull |
| 75 | lifting frame |
| 76 | rigging |
| 77 | rigging arrow |
| 80 | work boat |
| 81 | anchor ropes/rigging |
| 82 | vessel |
| 83 | arrow |
| 84 | beam |
| 85 | beam |
| 86 | flange |
| 87 | flange |
| 88 | web |
| 89 | gap/space |
| 90 | chain stopper/chock |
| 91 | chain stopper/chock |
| 92 | chain sheave |
| 93 | plate |
| 94 | shaft |
| 95 | interface device |
| 96 | peripheral portion |

All measurements disclosed herein are at standard temperature and pressure, at sea level on Earth, unless indicated otherwise.

The foregoing embodiments are presented by way of example only; the scope of the present invention is to be limited only by the following claims.

The invention claimed is:

1. A marine platform, comprising:

a) a plurality of individual buoys, each buoy having an upper section, a middle section and a lower section;

b) a platform deck having a central portion surrounded by a peripheral portion;

c) a plurality of articulating connections, the articulating connections connecting the upper section of each of the buoys to the platform deck;

d) wherein each articulating connection movably connects a buoy to the platform deck;

e) a plurality of mooring lines anchoring the platform structure to a seabed, each mooring line attached to the platform at a position that is spaced inwardly of the buoys;

f) each said mooring line is spaced in between two of said buoys, each line being inclined as the said line passes between said two buoys and above the bottom of the said two buoys at a position where the said line passes between the two buoys;

g) wherein the majority of the buoy sections are trusses, and wherein the upper and middle buoy sections each include multiple vertically extending and laterally spaced apart tubular members; and h) wherein each section contains a plurality of longitudinally extending corner members, and the longitudinally extending corner members of the upper buoyant section and the lower ballast section each have a greater cross sectional area than the longitudinally extending corner members of the middle truss section.

2. The marine platform of claim 1 wherein the mooring lines include at least a first mooring line that forms a first angle with a horizontal plane and a second mooring line that forms a second angle with a horizontal plane, wherein the second angle that is greater than the first angle.

3. The marine platform of claim 1 wherein a plurality of said mooring lines attaches to the platform deck central portion.

4. The marine platform of claim 1 wherein each of the mooring lines is attached to the platform deck within the platform peripheral portion.

5. The marine platform of claim 1 wherein each upper section has multiple generally cylindrically shaped sections.

6. The marine platform of claim 1 wherein the upper section has a vertical dimension that is less than one half the total vertical dimension of the buoy.

7. The marine platform of claim 1 wherein the upper section has a height that is less than one half the overall height of the buoy.

8. The marine platform of claim 1 wherein the upper section forms a truss.

9. The marine platform of claim 1 wherein the middle section forms a truss.

10. The marine platform of claim 1 wherein the upper section includes multiple rolled pipe sections having a maximum diameter of between about five and thirty feet.

11. The marine platform of claim 1 wherein each buoy upper section is comprised of multiple vertical cylindrical sections joined with multiple transverse sections.

12. The marine platform of claim 1 wherein each buoy lower section is comprised of multiple vertical cylindrical members joined with multiple transverse members.

13. The marine platform of claim 11 wherein each middle section includes multiple vertical cylindrical members.

14. The marine platform of claim 13 wherein each cylindrical member of the middle section is smaller in diameter than the diameter of said vertical cylindrical member of the upper section.

15. A marine platform, comprising:

a) a plurality of individual buoys, each buoy including an upper buoyant section, a lower ballast section and a middle truss section in between the upper buoyant and lower ballast sections, wherein each section contains a plurality of longitudinally extending corner members, and the longitudinally extending corner members of the upper buoyant section and the lower ballast section each have a greater cross sectional area than the longitudinally extending corner members of the middle truss section;

b) a platform deck that includes an oil and gas well producing facility weighing between 500 tons and 100,000 tons and a peripheral portion that includes a plurality of connecting positions, one connecting position for each buoy;

c) a plurality of articulating connections, respective articulating connections connecting the plurality of buoys to the platform deck at different respective connecting positions, the plurality of articulating connections allowing for buoy motions induced by sea movement;

d) wherein each articulating connection is a separate joint movably connecting one of the buoys to the platform deck or superstructure; and e) a plurality of mooring lines that attach between a seabed and the platform deck;

f) wherein a majority of said buoy sections are truss sections; and g) wherein at least said upper and said middle buoy sections have multiple laterally spaced apart tubular members.

16. The marine platform of claim 15 further comprising a mooring extending from the plurality of the buoys for holding the platform and buoys to a desired location.

17. The marine platform of claim 15 wherein each of the articulating connections is a universal joint.

18. The marine platform of claim 15 wherein each of the articulating connections includes concave and convex portions.

19. The marine platform of claim 15 wherein at least one buoy has a convex articulating portion and the platform has at least one concave articulating portion, the at least one convex articulating portion and the at least one concave articulating portion forming at least one articulating connection.

20. The marine platform of claim 15 wherein at least one buoy has a concave articulating portion and the platform has at least one convex articulating portion, the at least one concave articulating portion and the at least one convex articulating portion forming at least one articulating connection.

21. The marine platform of claim 15 wherein each buoy has a height and a diameter, the height being greater than the diameter.

22. The marine platform of claim 15 wherein there are at least three buoys and at least three connecting positions.

23. The marine platform of claim 15 wherein there are at least four buoys and at least four connecting positions.

24. The marine platform of claim 15 wherein the platform is comprised of a trussed deck.

25. The marine platform of claim 24 wherein the trussed deck has lower horizontal members, upper horizontal members, and a plurality of inclined members spanning between the upper and lower horizontal members, and wherein the connecting positions are next to the lower horizontal members.

26. The marine platform of claim 15 wherein each buoy is between 100 and 500 feet in height.

27. The marine platform of claim 15 wherein each buoy is between about 25 and 100 feet in diameter.

28. The marine platform of claim 15 wherein each buoy has a generally uniform diameter over a majority of its length.

29. The marine platform of claim 15 wherein each buoy has an upper end portion that is generally cylindrically shaped.

30. The marine platform of claim 15 wherein each articulated connection is comprised of a hemispherically shaped structure on a buoy and a correspondingly shaped concave receptacle on the platform that engages the hemispherically shaped structure.

31. The marine platform of claim 15 wherein the truss extends over a majority of the length of the buoy.

32. The marine platform of claim 1 wherein each buoy has an upper flotation portion, a lower ballast portion and a truss that spaces apart the flotation portion and the ballast portion.

* * * * *